US005676010A

United States Patent [19]

College et al.

[11] Patent Number: 5,676,010

[45] Date of Patent: Oct. 14, 1997

[54] WIRE STRAIGHTENING DEVICE

[75] Inventors: David Alan College, Annville; George Edward Hoover, Dover, both of Pa.

[73] Assignee: The Whitaker Corporation, Wilmington, Del.

[21] Appl. No.: 717,028

[22] Filed: Sep. 20, 1996

[51] Int. Cl.[6] ..... B21D 3/04; B21D 3/05; B21D 1/02; B21D 3/02

[52] U.S. Cl. ..... 72/162; 72/164

[58] Field of Search ..... 72/140, 147, 160, 72/162, 164, 165, 244

[56] References Cited

U.S. PATENT DOCUMENTS 3,309,907 3/1967 Steinhardt ..... 72/164
4,005,592 2/1977 Haeussler ..... 72/165

*Primary Examiner*—Lowell A. Larson
*Assistant Examiner*—Rodney A. Butler
*Attorney, Agent, or Firm*—T. J. Abenle

[57] ABSTRACT

A wire straightening device (62) is disclosed for use on a wire processing machine (60). The device includes two wire deflection units (72, 74) arranged to deflect the wire in two perpendicular planes to remove stresses in the wire. Each wire deflection unit includes a first member (90) having a set of upper rollers (92, 94, 96) arranged thereon and a second member (110) having a set of lower rollers (112, 114, 116, 118) journaled thereon. The two sets of rollers are adjustable toward and away from each other for deflecting engagement with a wire (78) to be straightened. The wire traverses through the wire deflection unit along a wire path (80) from an inlet side (132) to an outlet side (134), The spacing of the rollers (92,94 and 112,114) adjacent the inlet side (132) is greater than the spacing of the rollers (94,96 and 116,118) adjacent the outlet side (134) so that the spacing is progressively less from the inlet side toward the outlet side. A manually actuated cam (200) is provided for moving the rollers to an open position for inserting the wire and then to a closed position where the wire is initially deflected.

15 Claims, 7 Drawing Sheets

WIRE STRAIGHTENING DEVICE

The present invention is related to wire processing machines and more particularly to wire straightening devices for removing the stresses in a wire and straightening it prior to feeding it into the machine for processing.

BACKGROUND OF THE INVENTION

Machines that utilize electrical wire in the manufacture of a product typically draw lengths of wire from an endless source, such as a reel, and feed the drawn wire into mechanisms that operate on the wire in some way to produce the product. Sometimes the wire is cut to a specific length and it becomes the product, other times the wire is used to interconnect electrical components in a product. The former, for example, is made by a machine that is typically called a "lead maker" in the industry. These machines draw wire from an endless source, measuring its length precisely, then cutting it to a desired length. The ends may or may not be terminated to electrical terminals, or the ends may simply be prepared for termination. The wire, as it is drawn from the barrel or reel, is usually stressed so that it has a tendency to curve or coil into its previous shape. This can make it difficult to correctly handle the wire and precisely control its feed rate. To overcome this problem devices have been developed for removing these stresses so that the wire will remain as straight as possible. The devices typically include two sets of opposed rollers on opposite sides of the wire that deflects the wire as it is being pulled through. There are usually two such devices arranged one after the other and at a 90 degree angle to each other so that the wire is first deflected back and forth along one plane and then back and forth along another plane normal to the first plane. This deflecting, or working, of the wire is schematically illustrated in FIGS. 1 and 2 where a first set of upper rollers 10, 12, 14, 16, and 18 are arranged adjacent a second set of lower rollers 20, 22, 24, and 26. The lateral spacing 28 between adjacent rollers of the same set are identical. The spacing 28 is small so that adequate deflection of the wire will occur to eliminate the stress and to minimize the overall length of the unit. The upper rollers are positioned offset with respect to the lower rollers, the set of lower rollers being angled a small amount away from the set of upper rollers from left to right. As shown in FIG. 1, a large diameter wire 30 is in place between the two sets of rollers. The wire is pulled toward the right, as viewed in FIG. 1, causing the wire 30 to undergo a maximum deflection 32 in an upward direction followed be a maximum deflection 34 in a downward direction. Since the lower set of rollers are angled with respect to the upper set of rollers, the next upward deflection 36 is less that the upward deflection 32 and similarly, the next downward deflection 38 is less than the previous downward deflection 34. Similarly, the final upward and downward deflections 40 and 42, respectively, are less that the deflections 36 and 38, respectively. The object is to work the wire hard by deflecting it further in the beginning of the operation and to progressively work it less and less as the wire is pulled toward the right, as viewed in FIG. 1. Initially when the wire 30 is inserted between the two sets of rollers, it is somewhat straight and the two sets of rollers are further apart. The two sets of rollers are then adjusted toward each other thereby deflecting the wire to conform to the shape shown in FIG. 1. This adjusting of the two sets of rollers toward each other is accomplished by a thumb screw, not shown, and requires a considerable amount of effort to accomplish for the larger diameter wires. As will be appreciated by those skilled in the art, the wire is essentially a beam that must be deflected by the first lower roller 20 centered opposite the first two upper rollers 10 and 12. Because the beams is supported very close to the point where deflection is desired, the required force is very high. This adjustment is made for each different wire diameter. See for example FIG. 2, where there is shown a smaller diameter wire 44 that is between the two sets of upper and lower rollers. Here, the two sets of rollers are closer together than in FIG. 1, and the maximum upward and downward deflections of the wire 44 are shown at 46 and 48, in a manner similar to that of the wire 30. If the smaller diameter wire 44 were to be inserted between the two sets of rollers with the separation shown in FIG. 1, as shown in phantom lines in FIG. 1, the maximum upward and downward deflections 50 and 52, respectively, would be too small to be effective. Therefore, the two sets of rollers must be adjusted with respect to each other so that the wire is deflected an adequate amount to effectively relieve the internal stresses. While it is desirable to be able to adjust the two sets of rollers so that they can accommodate a range of different wire diameters, the equal and close spacing 28 of the rollers makes this difficult to do. For example, should the larger diameter wire 30 be forced between the rollers set for the smaller diameter wire 44, the distances between the lower roller 20 and the two upper rollers 10 and 12 may be too close so that the wire would be extruded as it passed between them necessitating a very high pulling force. This, of course, undesirably alters the characteristics of the wire.

What is needed is a wire straightening device that works the wire during operation by substantially deflecting it yet requires relatively small forces to adjust the setting of the two sets of rollers during setup when initially deflecting the wire. Additionally, the wire straightening device should be able to accommodated a range of wire diameters with a single adjusted setting.

SUMMARY OF THE INVENTION

A wire straightening device is disclosed having an inlet and an outlet for removing stresses in a wire and straightening the wire prior to feeding it into a machine for processing. The device includes a frame having a wire path along which the wire is fed from an inlet, through an outlet. A first set of spaced apart rollers are journaled for rotation on a first member and arranged on a first side of and adjacent to the wire path. A second set of spaced apart rollers are journaled for rotation on a second member and arranged on a second side of and adjacent to the wire path, the wire path being between the first and second sets of spaced rollers. The individual space between the rollers in the first set of rollers is relatively large near the inlet and relatively small near the outlet.

DESCRIPTION OF THE PREFERRED EMBODIMENT

Figure 1:
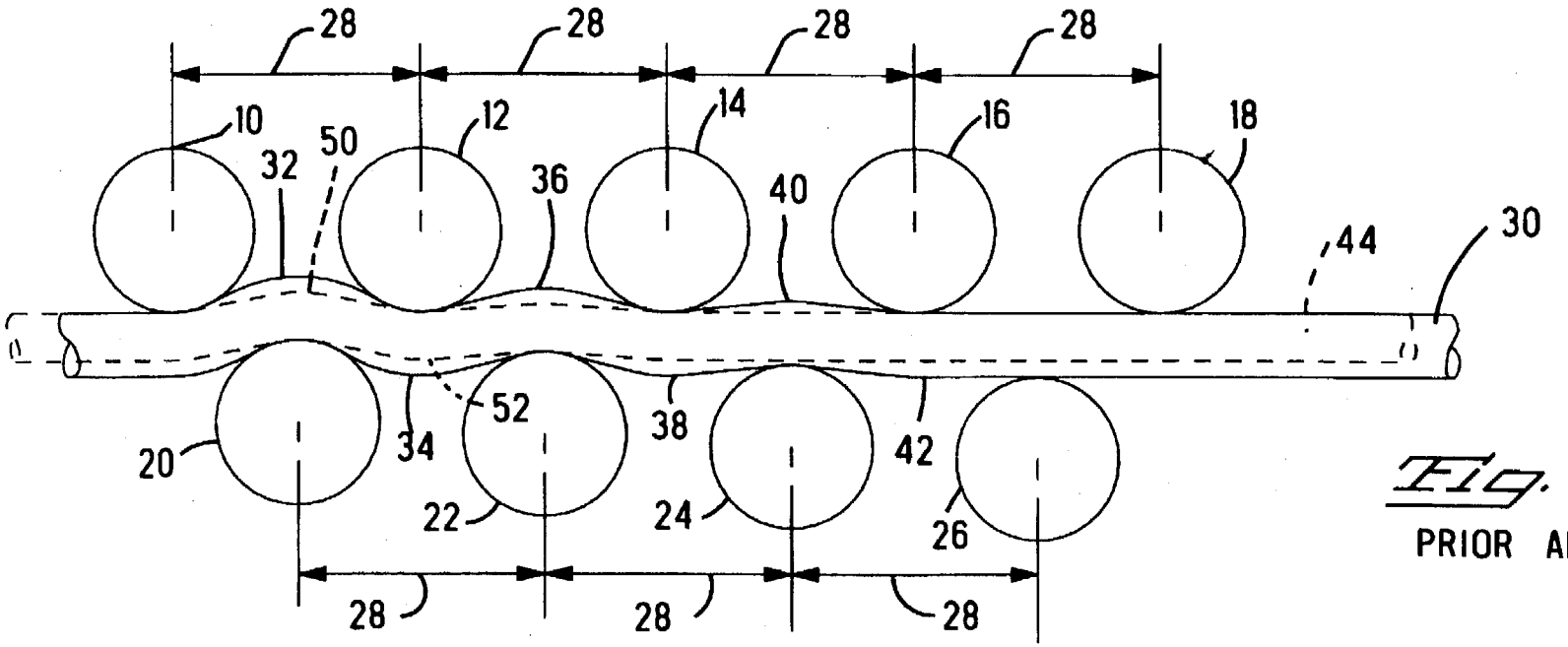
FIG. 1 PRIOR ART
FIGS. 1 and 2 are schematic representations of a prior art wire straightening device.
Figure 2:
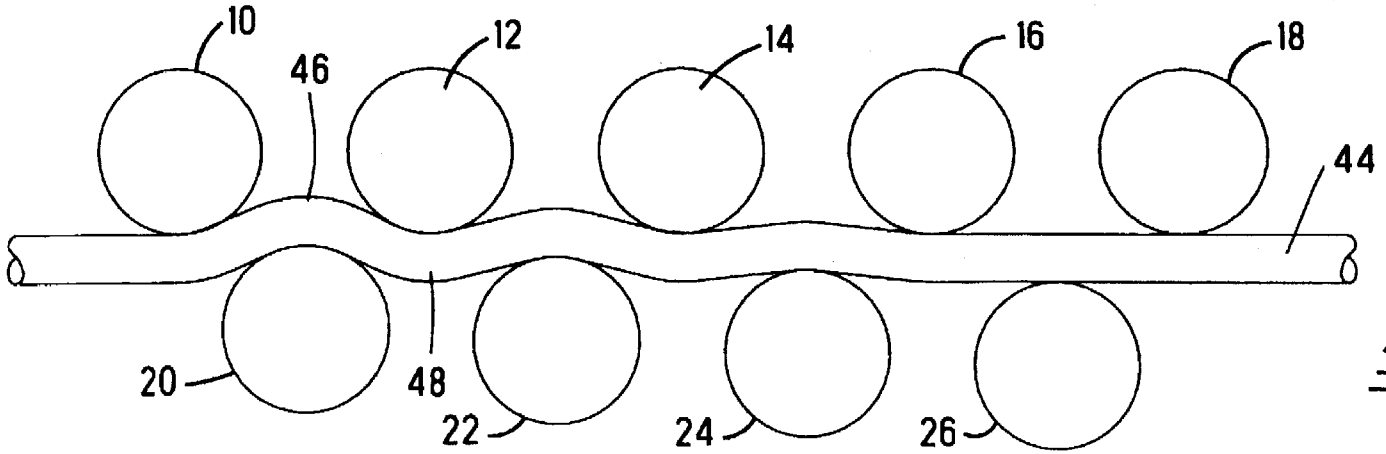
FIG. 2 PRIOR ART
Figure 3:
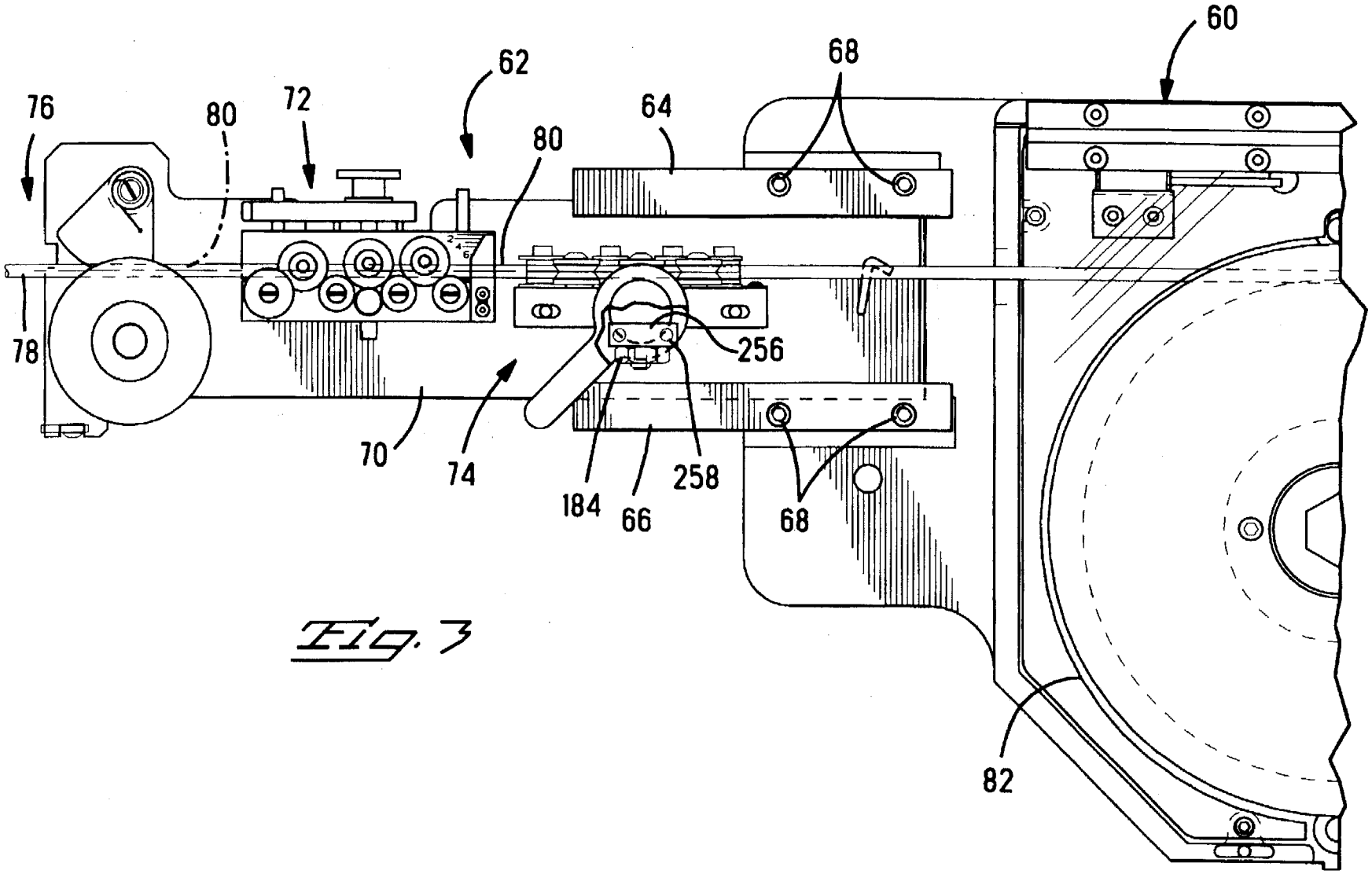
FIGS. 3 and 4 are front and top views, respectively, of a portion of a wire processing machine having a wire straightening device incorporating the teachings of the present invention.
Figure 4:
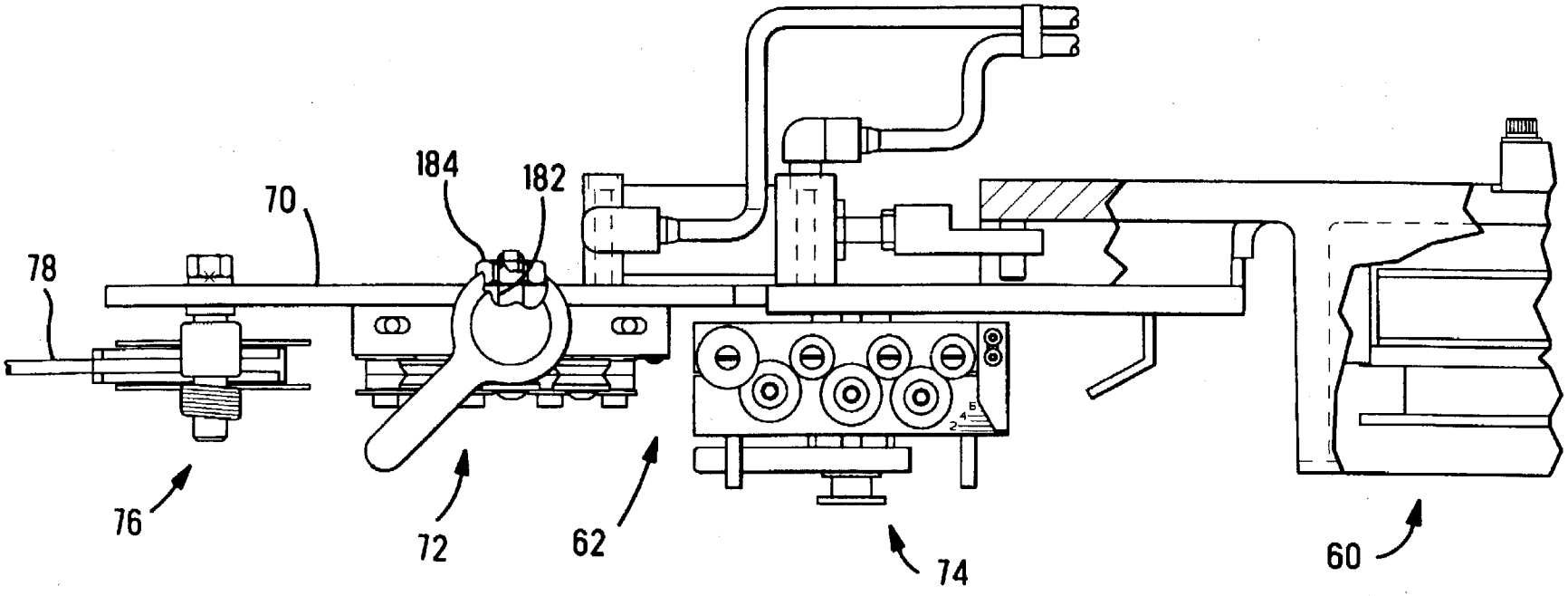

There is shown in FIGS. 3 and 4, a wire processing machine 60 having a wire straightening device 62 slidingly attached thereto by means of a pair of spaced gibs 64 and 66 and screws 68 that are threaded into the frame of the machine 60. The wire straightening device 62 includes a frame 70, a first wire deflection unit 72, a second wire deflection unit 74, and a wire antibackup guide 76, all of which are secured to the frame 70. The antibackup guide 76 receives a wire 78 and guides it toward the first wire deflection unit 72 while allowing the wire to move in only one direction, in the usual manner. The wire 78 moves from left to right, as viewed in FIG. 3, through the first and second wire deflection units 72 and 74 along a wire path 80. The first wire deflection unit 72 deflects the wire in the plane of the paper, as viewed in FIG. 3, while the second wire deflection unit 74 deflects the wire in a plane that is normal thereto. The straightened wire exits the second wire deflection unit 74 and extends into a wire feed unit 82 which pulls the wire 78 along the wire path 80 through the wire straightening device 62 and feeds it into the wire processing machine 60. The first and second wire deflection units 72 and 74 are similar, one being a mirror image of the other, except in the manner in which they are mounted to the frame 70, therefore, the first wire deflection unit will be described in detail followed by a brief description of the mounting of the second unit 74.

Figure 5:
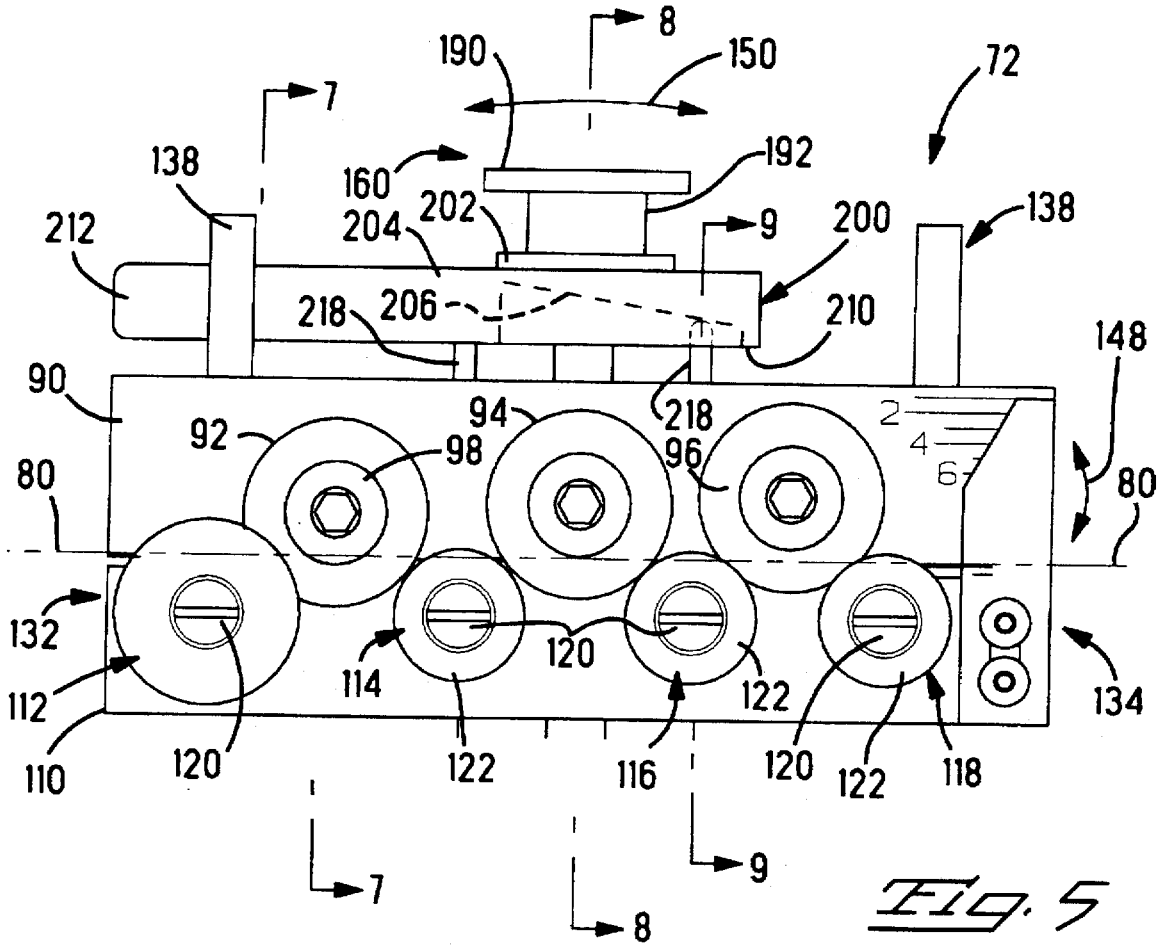
FIGS. 5 and 6 are front and top views, respectively, of a wire deflection unit shown in FIGS. 3 and 4.
Figure 6:
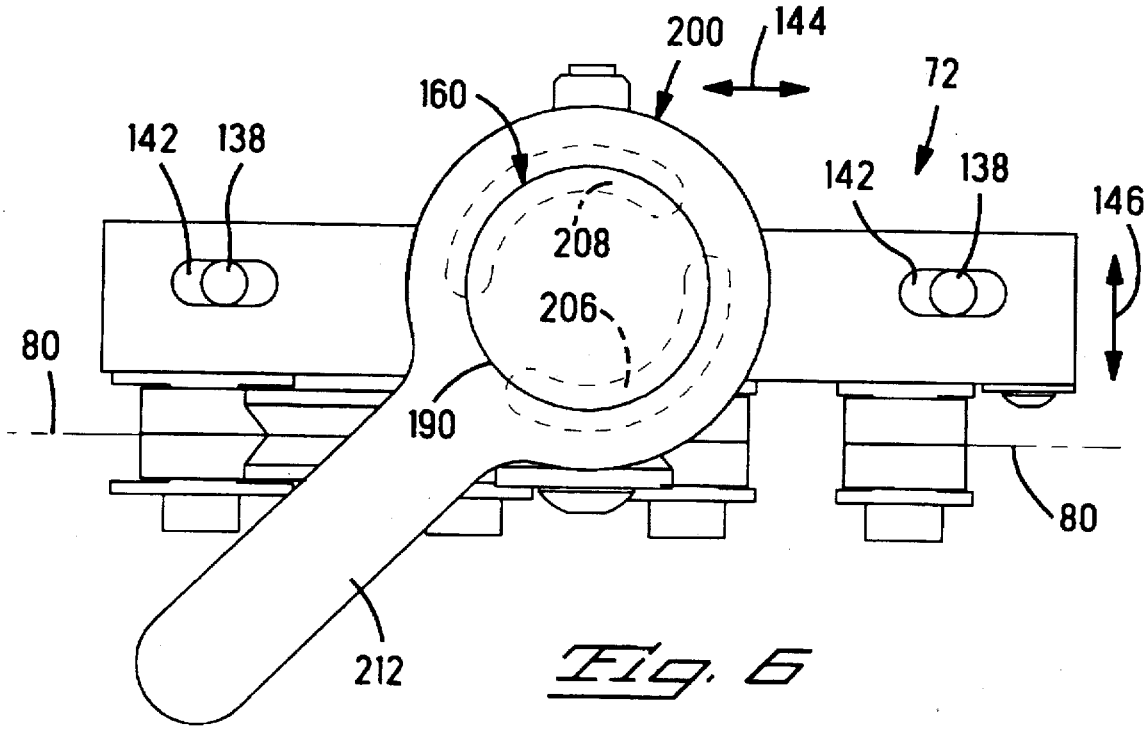
Figure 7:
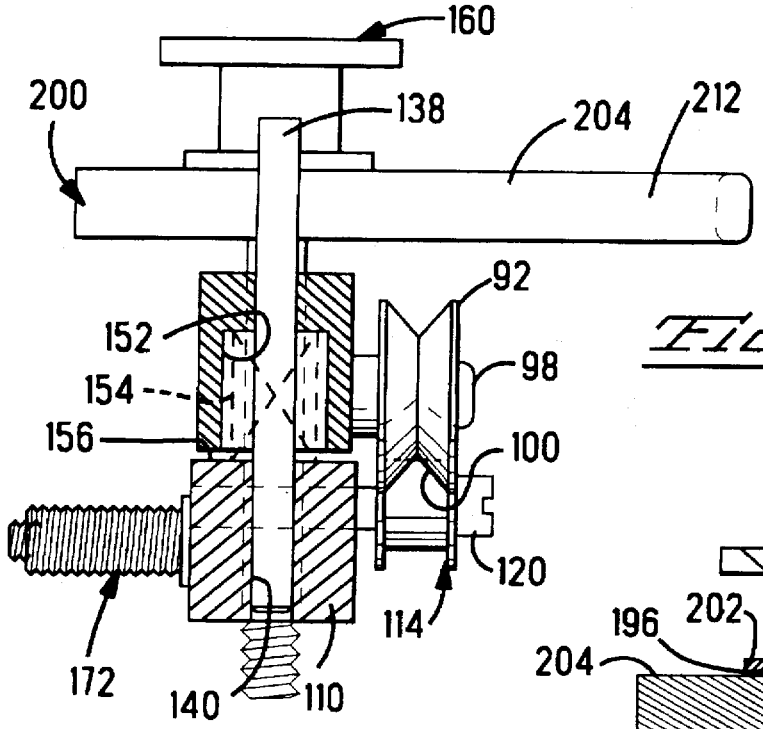
FIG. 7 is a cross-sectional view taken along the lines 7—7 in FIG. 5.
Figure 8:
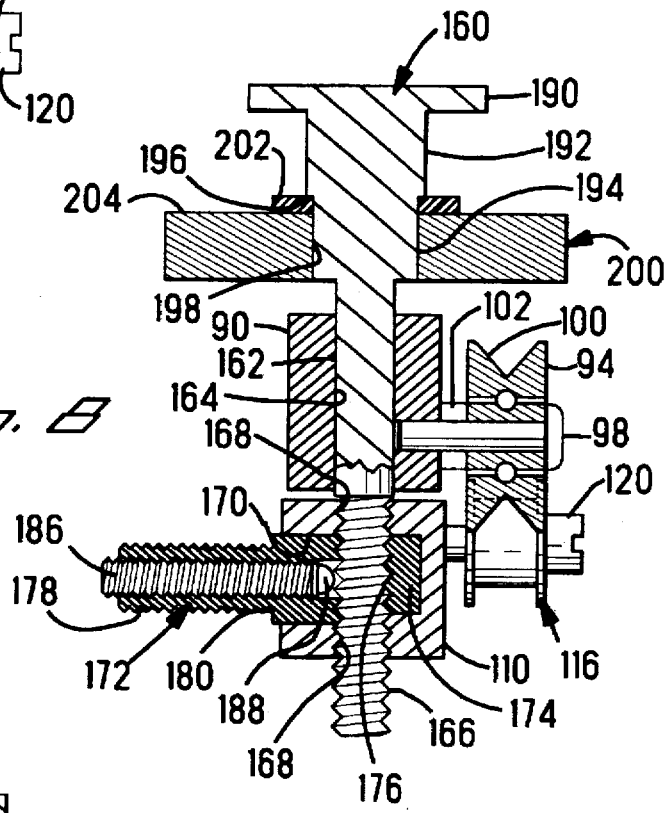
FIG. 8 is a cross-sectional view taken along the lines 8—8 in FIG. 5.
Figure 9:
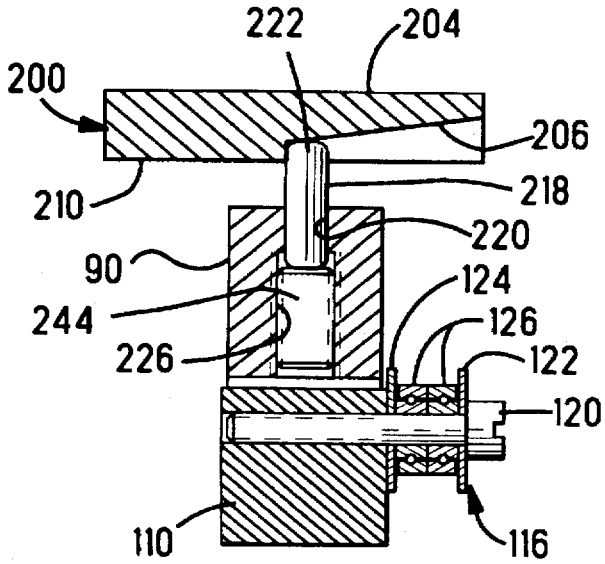
FIG. 9 is a cross-sectional view taken along the lines 9—9 in FIG. 5.
Figure 10:
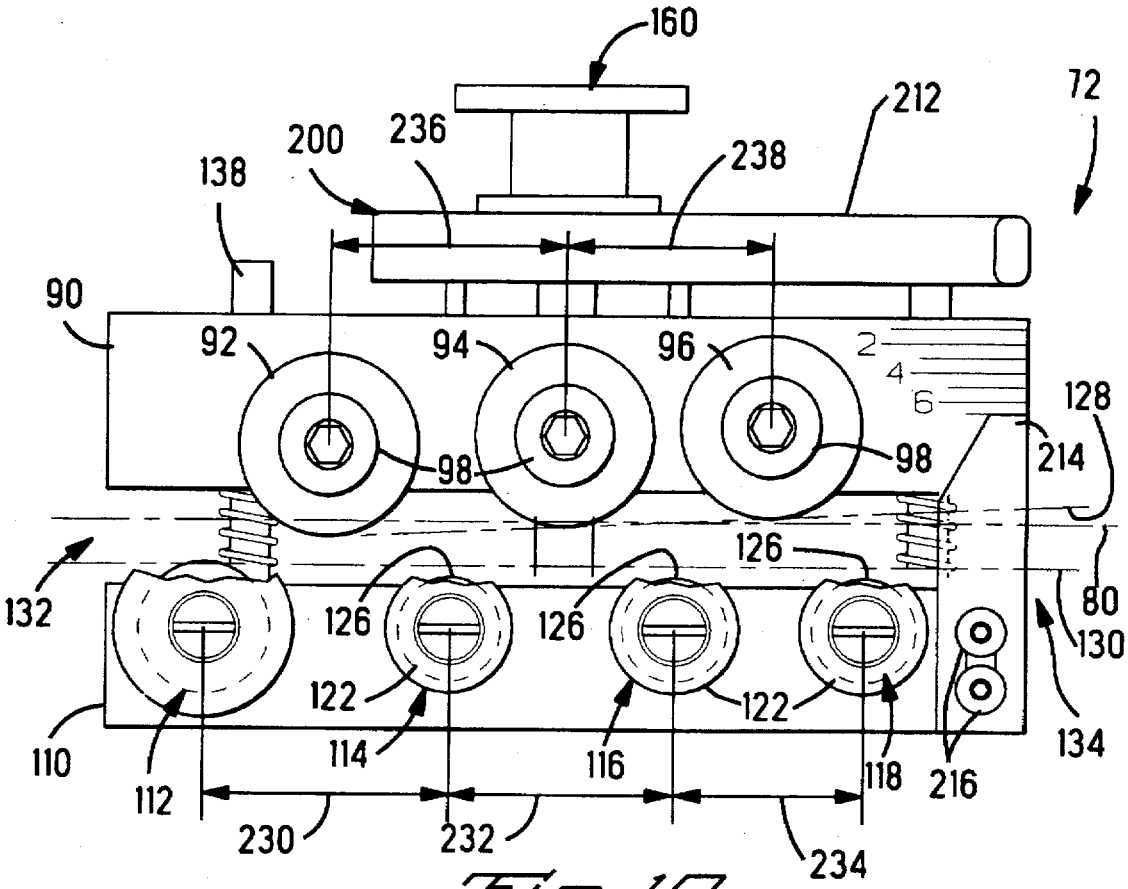
FIGS. 10 and 11 are views similar to that of FIG. 5 showing the wire deflection unit in its open and closed positions, respectively.
Figure 11:
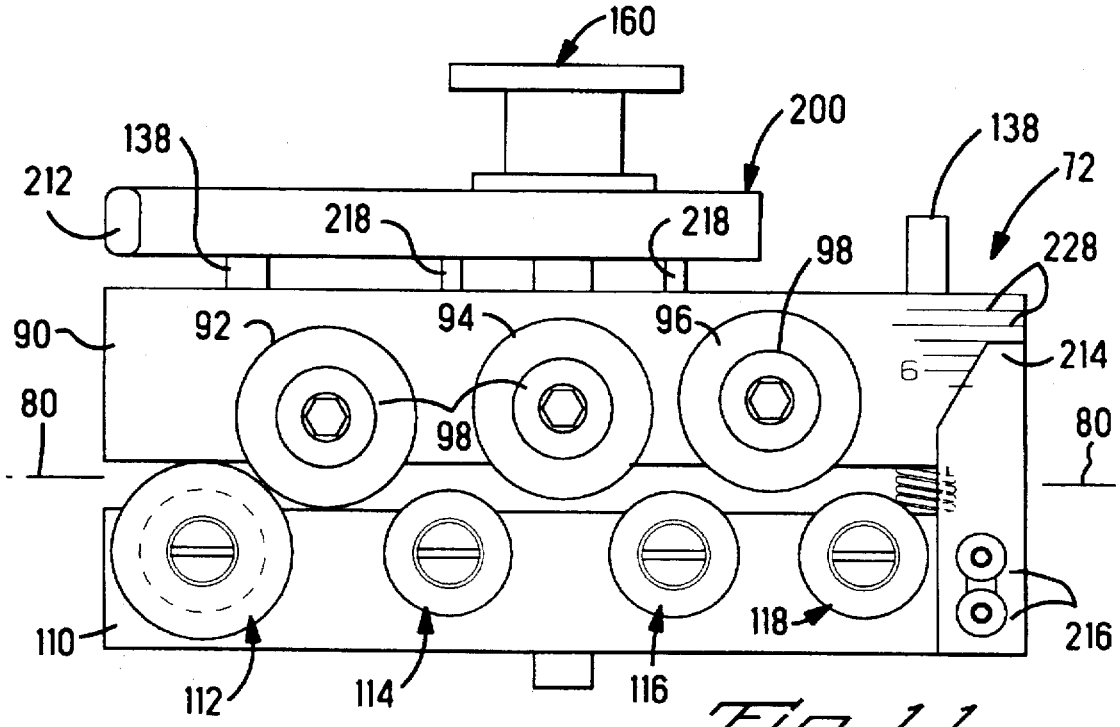

The first wire deflection unit 72, as shown in FIGS. 5 through 9, includes a first member 90 having a first set of upper rollers 92, 94, and 96 arranged for rotation on the axes of screws 98 that are threaded tightly into holes in the first member 90, as best seen in FIG. 8. Each of the rollers 92, 94, and 96 are ball bearings having a V-shaped groove 100 formed in their outer races. A spacer 102 is disposed between the edge of each of the inner races of the bearings and the wall of the first member 90. The heads of the screws 98 bear against the inner race securing it and the spacer tightly against the first member 90 while the outer races are free to rotate. A second member 110 is arranged vertically below the first member 90, as viewed in FIG. 5, and has a set of lower rollers 112, 114, 116, and 118 arranged for rotation on the axes of screws 120 that are threaded tightly into holes in the second member 110, as best seen in FIG. 9. Each of the upper rollers 92, 94, and 96, is positioned vertically above and between a respective two of the lower rollers 112,114, 114,116, and 116,118, as shown in FIG. 5. Each of the rollers 112, 114, 116, and 118 are composed of two ball bearings 126 arranged side by side. A pair of washers 122 are disposed on opposite sides of each pair of ball bearings so that they bear against the inner races of the bearings. The heads of the screws 120 sandwich the two inner races of the ball bearings 126 and washers 122 together and secure the assembly tightly against the second member 110, while the outer races of the ball bearings are free to rotate. It will be noted that the first lower roller 112 has larger diameter washers 124 in place of the washers 122 to aid in initially guiding the wire 78 into the wire deflection unit 72. As best seen in FIG. 10, the outer surfaces of the upper rollers 92, 94, and 96 define a first line 128 and the outer surfaces of the ball bearings 126 define a second line 130. These two lines diverge from an inlet side 132 toward an outlet side 134 of the first wire deflection unit 72. While, in the present example, the lines 128 and 130 are straight lines, the teachings of the present invention may be advantageously practiced wherein either or both of the lines 128 and 130 are curved.

As best seen in FIGS. 5 and 7, the first member 90 is slidingly coupled to the second member 110 by means of two pins 138 that are pressed into spaced apart holes 140 formed in the second member 110. The pins 138 extend through elongated holes 142 formed in the first member 90. The elongated holes 142 are sized to allow slight longitudinal movement of the first member 90 with respect to the second member 110 in a direction indicated by the arrow 144, as seen in FIG. 6, but prevent lateral movement in the direction indicated by the arrow 146. As will be described below this longitudinal movement is affected somewhat by the mounting mechanism and actually results in a pivotal movement of the first member 90, as indicated by the arrows 148 and 150 in FIG. 5. The elongated holes 142 have counterbored portions 152 containing compression springs 154 that extend from the bottom of each counterbore to the surface 156 of the second member 110. The two springs 154 urge the first and second members 90 and 110 apart so that the first member slides upwardly on the pins 138, as viewed in FIG. 7.

A lead screw 160 includes a small diameter portion 162 that extends through and is a slip fit with a hole 164 formed in the first member 90, as best seen in FIG. 8. The small diameter portion 162 has a threaded end 166 that extend through a clearance hole 168 that is formed through the second member 110. A blind hole 170 is formed in the second member 110 so that it is normal to and intersects the clearance hole 168. A pivot pin 172 includes a cylindrically shaped head 174 that is a slip fit with the blind hole 170 and has a threaded hole 176 that is in threaded engagement with the threaded end 166 of the lead screw 160. The pivot pin terminates in a threaded reduced diameter 178 extending from a shoulder 180, the diameter 178 extending through a hole 182 formed through the frame 70, as best seen in FIG. 4. A nut 184 is threaded onto the threaded diameter 178 and pulls the shoulder 180 tightly against the surface of the frame, thereby securing the first wire deflection unit 72 to the frame 70. A spring plunger 186 is threaded into a hole formed axially within the diameter 178 and into intersection with the clearance hole 176, as best seen in FIG. 8. The tip 188 of the spring plunger is a resilient material that frictionally engages the threads of the threaded end 166 tending to hold the lead screw 160 against inadvertent rotation during operation of the machine 60, yet allowing deliberate rotation when performing adjustments to the wire deflecting unit 72. The lead screw 160 includes an enlarged head 190 having a knurled outer surface and first and second intermediate diameters 192 and 194, respectively, that form a shoulder 196 at their intersection. The second intermediate diameter 194 is a slip fit with a hole 198 formed through a cam member 200, as best seen in FIG. 8. A thrust washer 202 is disposed between the shoulder 196 and the top surface 204 of the cam member 200. The cam member 200 includes a pair of diametrically opposite ramp surfaces 206 and 208 formed in the bottom surface 210 of the cam member 200, as best seen in FIGS. 5, 6, and 9. The two ramp surfaces 206 and 208 take the shape of curved elongated slots, as viewed in FIG. 6, having walls that are concentric with the hole 198. A handle 212 extends from the cam member 200, as best seen in FIGS. 5 and 6, for manually rotating the cam member, as will be described below. A pair of follower pins 218 extend through spaced apart slip fit holes 220 formed in the first member 90, the holes being spaced to position each of the pins in engagement with a respective one of the ramp surfaces 206 and 208. The tips 222 of the follower pins 218 are rounded to reduce friction between the tips and the ramp surfaces. The opposite ends of the follower pins 218 are supported by set screws 224 that are threaded into holes 226 formed in the first member 90 concentric to the slip fit holes 220. The set screws 224 allow for precise axial positioning of the follower pins 218.

The second wire deflection unit 74, as shown in FIG. 3, is mounted to a bracket 256, the threaded diameter 178 extending through a hole in the bracket. Another nut 184 is threaded onto the threaded diameter 178 and pulls the shoulder 180 tightly against the surface of the bracket, thereby securing the second wire deflection unit 74 to the bracket 256. The bracket 256 is rigidly attached to the frame 70 by means of screws 258 that extend through holes in the bracket and into threaded holes in the frame.

Figure 12:
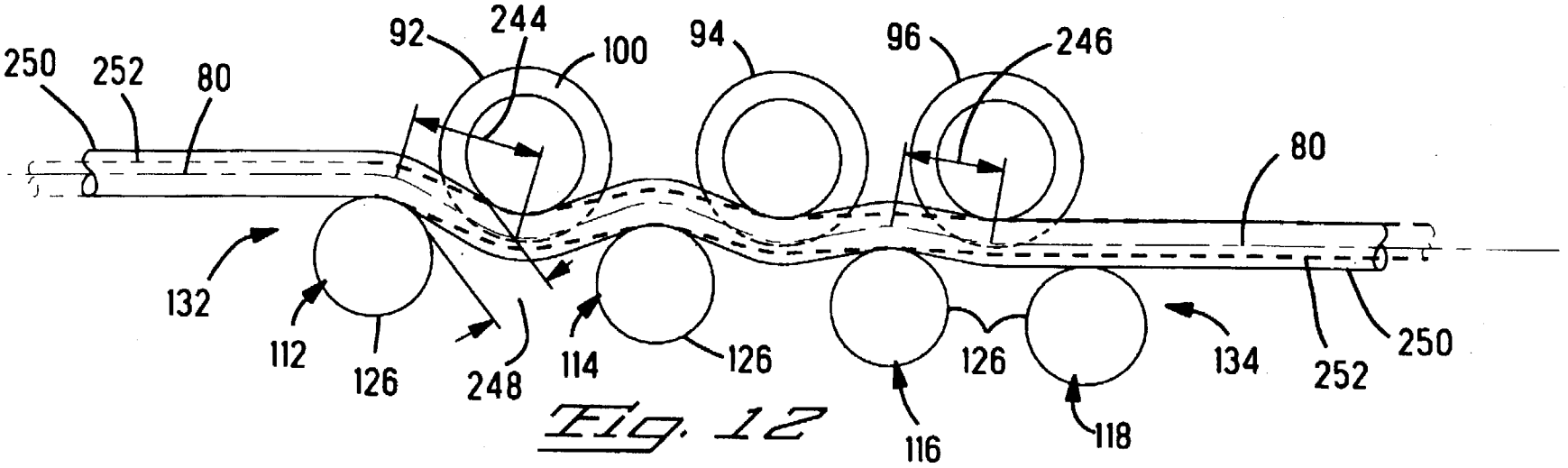
FIG. 12 is a schematic representation of the wire deflection unit showing its operation on a wire.

The operation of the wire straightening device 62 will now be described with reference to FIGS. 5, 6, 10, 11, and 12. It will be understood that for every operation described below with respect to the first wire deflection unit 72 there will be a corresponding similar operation performed with respect to the second wire deflection unit 74 that is not specifically described. The handle 212 is moved from the position shown in FIGS. 5 and 6, 90 degrees counterclockwise to the position shown in FIG. 10. This causes the tips 222 of the follower pins 218 to ride up their respective ramp surfaces 206 and 208 to the full depth thereof. As the pins 218 follow the ramp surfaces the springs 154 urge the first member 90 upwardly along the pins 138 and away from the second member 110 to the open position shown in FIG. 10. A wire 78 is then moved laterally, with respect to the wire straightening device 62 into position between the two sets of upper and lower rollers. The handle 212 is then moved clockwise to the position shown in FIGS. 6 and 11 causing the follower pins 218 to track down their respective ramp surfaces 206 and 208, forcing the first member 90 downwardly against the urging of the springs 154 toward the second member 110 to the closed position shown in FIG. 11. When this occurs the wire 78 is deflected in alternate directions as shown in FIG. 12. As the wire is deflected, both first and second members 90 and 110 will pivot slightly, according to the arrows 148 and 150, as the upper and lower rollers seek their respective alignment where all of the forces balance. The machine 60 is then operated in the usual manner, the wire 78 being pulled through the wire straightener 62, which removes the stresses in the wire allowing it to emerge relatively straight. As will be described below, the wire deflector 72 can accommodate a range of different wire diameters without readjusting the relative spacing between the first and second members 90 and 110. However, when it is desired to process a wire that is out of the present range. the lead screw 160 is rotated either clockwise or counterclockwise to move the first member 90 toward or away from the second member 110, respectively, so that the two sets of upper and lower rollers are move closer or further apart. An adjustment indicator finger 214 is secured to the side of the second member 110 by means of screws 216 that are threaded into holes in the second member. Indices 228 are arranged on the side of the first member 90 for comparison with the top of the finger 214 as an indication of the spacing between the two sets of rollers.

As best seen in FIG. 10, the space 230 between the rollers 112 and 114 is greater than the space 232 between the two rollers 114 and 116 which is also greater than the space 234 between the two rollers 116 and 118. That is, the spaces 230, 232, and 234 become progressively smaller from the inlet 132 to the outlet 134. Similarly, the space 236 between the two upper rollers 92 and 94 is greater than the space 238 between the two rollers 94 and 96. This difference in spacing that becomes progressively smaller from the inlet 132 to the outlet 134 is important because it permits a longer beam 244 of wire that must be deflected in the beginning near the inlet 132 where the amount of deflection is greatest, as best seen in FIG. 12, yet permits a shorter beam 246 near the outlet 134 where the amount of deflection is least. This effectively reduces the amount of force required to achieve the initial deflection, when moving the handle 112 from the open position to the closed position, while concurrently maintaining the overall length of the wire deflection unit 72 to within a reasonable size. It is also important that the spacings 230, 232, and 234 be large enough so that when the largest diameter wire that is to be processed by the machine 60 is deflected, the minimum distance 248 between an upper roller and a lower roller, as shown in FIG. 12, is greater than the diameter of the wire. This will permit a range of different wire diameters to be sufficiently deflected to relieve the stresses therein with a given setting by the lead screw 160. For example, a relatively large diameter wire 250 is shown in its deflected position between the sets of upper and lower rollers in FIG. 12. Additionally, a relatively smaller diameter wire 252 is shown in phantom lines superimposed on the same figure. It can be seen that both the large and small wires have undergone substantial deflection. By way of example, the present wire deflection unit 72 has 0.562 inch diameter lower rollers and a similar effective diameter for the upper rollers, and spacings 236 and 238 of 1.036 inches and 0.899 inch, respectively, and spacings 230, 232, and 234 of 1.074 inches, 0.9896 inch, and 0.882 inch, respectively.

Figure 13:
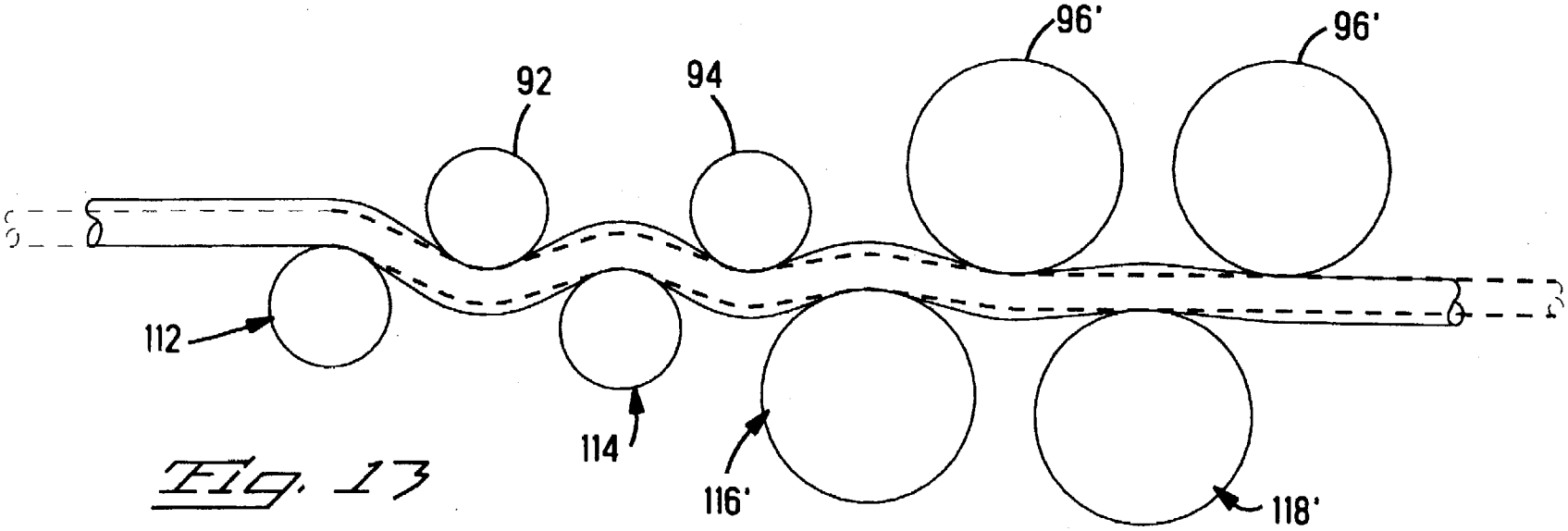
FIG. 13 is a schematic representation similar to that of FIG. 12 showing a variation in roller sizes.

The actual diameters of the two sets of upper and lower rollers may vary while practicing the teachings of the present invention. See, for example, FIG. 13 where the last two upper and lower rollers 96', 116', and 118' near the outlet 134 are larger than the other rollers 92, 94, 112, and 114. The larger diameters can reduce the surface stresses in the wires in the area where the wire is being deflected a minimum amount just prior to exiting from the wire deflecting unit. Other variations in diameters are also possible including fewer or more rollers in either the set of upper rollers or the set of lower rollers.

An important advantage of the present wire straightening device is that substantially less force is required to initially deflect the wire during set up when a wire is first positioned between the two sets of upper and lower rollers and the rollers are closed. Additionally, the greater spacing of the rollers adjacent the inlet permits the accommodation of a range of wire diameters within each specific setting of the lead screw.

We claim:

1. A wire straightening device having an inlet and an outlet for removing stresses in a wire and straightening said wire prior to feeding it into a machine for processing, including a first wire deflection unit arranged to deflect said wire in a first plane comprising:

(a) a frame having a wire path along which said wire is fed from said inlet, through said outlet;

(b) a first set of spaced apart rollers arranged for rotation on a first member and arranged on a first side of and adjacent to said wire path;

(c) a second set of spaced apart rollers arranged for rotation on a second member and arranged on a second side of and adjacent to said wire path, said wire path being between said first and second sets of spaced rollers;

wherein the individual space between the rollers in said first set of rollers is relatively large near said inlet and relatively small near said outlet.

2. The device according to claim 1 wherein some of said rollers of said first set of rollers are each positioned vertically, with respect to said wire path, between two adjacent rollers of said second set of rollers.

3. The device according to claim 1 wherein some of said rollers of said first and second sets of rollers are larger in diameter than others of said rollers.

4. The device according to claim 1 including a second wire deflection unit disposed between said first wire deflection unit and said machine and arranged to deflect said wire in a second plane perpendicular to said first plane.

5. The device according to claim 2 wherein each roller of said first set of rollers includes a peripheral surface that is tangent to a first line extending along said first side of said wire path and wherein each roller of said second set of rollers includes a peripheral surface that is tangent to a second line extending along said second side of said wire path, wherein said first and second lines diverge toward said outlet.

6. The device according to claim 5 wherein one of said first and second members is arranged to undergo pivotal movement with respect to the other member.

7. The device according to claim 6 wherein one of said first and second members is pivotally attached to said frame.

8. The device according to claim 7 wherein one of said first and second members is movable in a direction substantially perpendicular to said wire path toward said other said member to a closed position and away from the other said member to an open position.

9. The device according to claim 8 wherein said second member includes a pair of guides extending therefrom through guide openings in said first member, including resilient means between said first and second members tending to urge said first member away from said second member.

10. The device according to claim 9 wherein said guide openings are clearance openings for said guides arranged to allow said pivotal movement of said first member with respect to said second member.

11. The device according to claim 10 including a lead screw threadingly coupled to said frame and having a shoulder abuttingly coupled to said first member so that when said lead screw is turned in one direction said shoulder urges said first member toward said second member and when turned in an opposite direction said shoulder recedes from said first member, whereby said resilient means urges said first and second members apart.

12. The device according to claim 11 including a pin secured to said frame and extending into a hole in said second member for effecting said pivotal attachment thereof, wherein said lead screw is in threaded engagement with a hole in said pin for effecting said threaded coupling thereof to said frame.

13. The device according to claim 11 including a cam pivotally coupled to said lead screw and disposed between said shoulder and said first member for effecting said abutting coupling of said shoulder to said first member and arranged so that when said cam is pivoted in one direction said first member is urged away from said shoulder and toward said second member to said closed position, and when said cam is pivoted in the other direction said first member is allowed to move toward said shoulder under the urging of said resilient means to said open position.

14. The device according to claim 13 wherein said larger diameter rollers are disposed along said wire path adjacent said outlet.

15. The device according to claim 4 wherein said second wire deflection unit is substantially similar to said first wire deflection unit.

* * * * *